United States Patent [19]

Snider

[11] Patent Number: 4,665,994

[45] Date of Patent: May 19, 1987

[54] POST DRIVING IMPLEMENT

[76] Inventor: Ovis A. Snider, Rte. 3, Box 327, Seymour, Mo. 65746

[21] Appl. No.: 667,342

[22] Filed: Nov. 1, 1984

[51] Int. Cl.[4] ..... B25D 9/00

[52] U.S. Cl. ..... 173/90; 173/91; 173/128; 405/232

[58] Field of Search ..... 173/90, 91, 128, 129, 173/132, 164; 405/232

[56] References Cited

U.S. PATENT DOCUMENTS

| | | | |
|---|---|---|---|
| 1,954,523 | 4/1934 | Doyle | 405/232 |
| 3,019,608 | 2/1962 | Marmion | 405/232 |
| 3,474,870 | 10/1969 | Cook | 173/91 |

FOREIGN PATENT DOCUMENTS

| | | | |
|---|---|---|---|
| 741520 | 8/1966 | Canada | 405/232 |
| 975499 | 3/1951 | France | 173/91 |
| 188061 | 10/1922 | United Kingdom | 173/91 |

*Primary Examiner*—James M. Meister
*Assistant Examiner*—Willmon Fridie, Jr.
*Attorney, Agent, or Firm*—Kokjer, Kircher, Bradley, Wharton, Bowman & Johnson

[57] ABSTRACT

A portable hand held post driver which is fully operable by a single worker and which uses a fluid powered cylinder to drive posts into the ground. The cylinder raises a balanced driving weight and forces the weight down onto the post. The cylinder is reversed automatically at both the top and bottom of its stroke to automatically repeat the driving strokes so long as a hand lever is held by the operator. The post is clamped to the frame of the implement by a clamp having an overcenter control linkage. Before the implement can be operated, a safety linking pin must be intentionally released by operating a safety lever.

19 Claims, 10 Drawing Figures

Fig. 1.
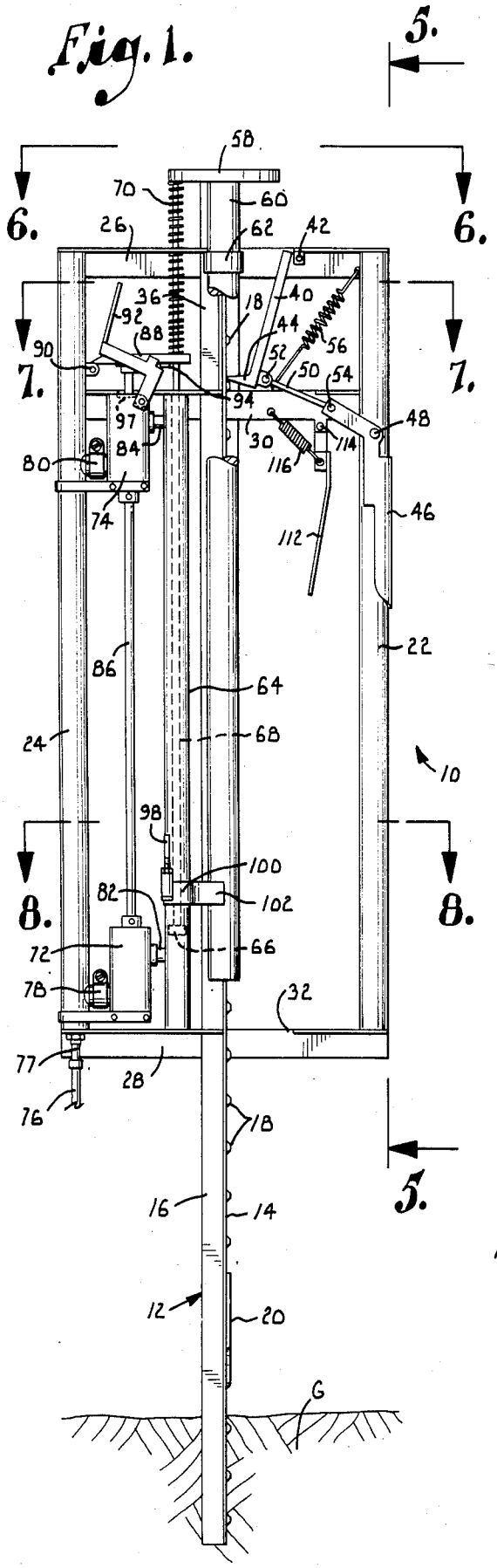
Fig. 2.
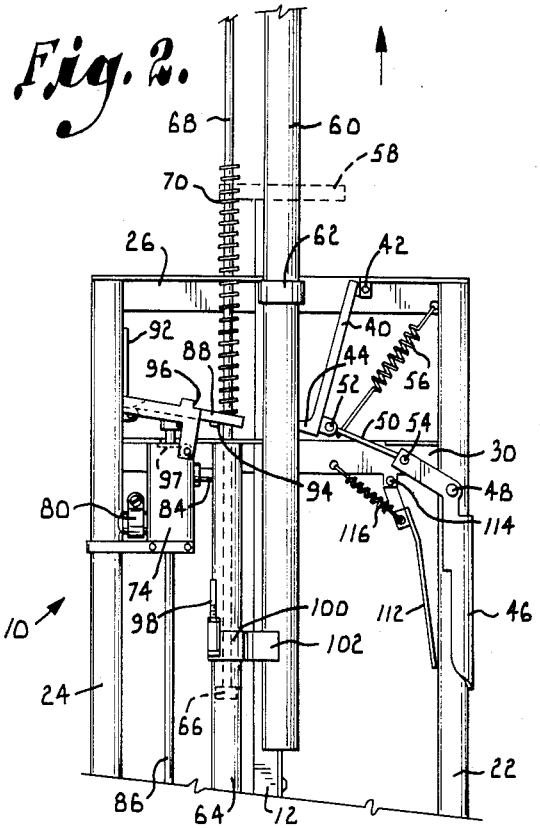
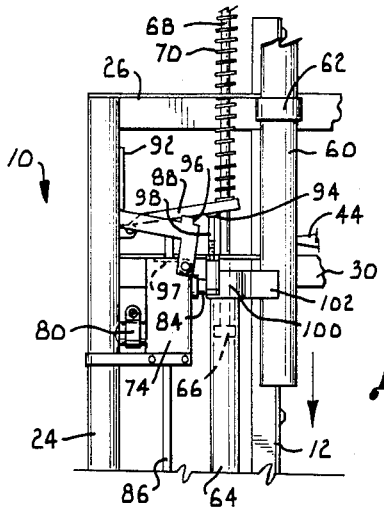
Fig. 3.
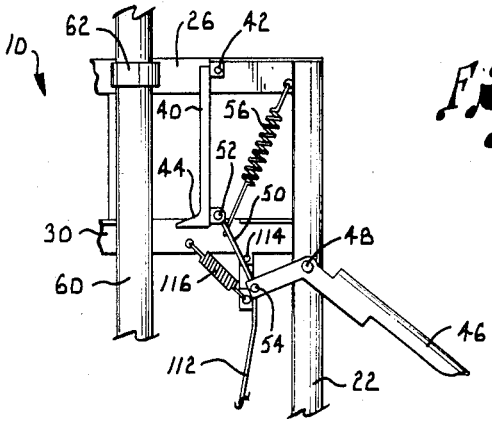
Fig. 4.

POST DRIVING IMPLEMENT

BACKGROUND AND SUMMARY OF THE INVENTION

This invention relates generally to the driving of posts and more particularly to a power operated post driving device which can be fully operated by a single workman.

At present, considerable manual effort is required to drive fence posts and other posts. The driving of metal fence posts typically involves the application of a suitable heavy, capped sleeve to the post and jerking this sleeve up and down until the post has been set to the desired depth. As can easily be appreciated, the physical labor is increased significantly if a large number of posts must be driven or if the soil is especially hard as when it is rocky or dry. Adding to the labor requirements is the necessity for the sleeve to be lifted overhead in order to remove it from the post after completion of the post driving operation. Another problem is that the posts tend to turn as they are driven, and it is difficult to maintain the studded faces of the posts in the proper orientation to receive the fencing material which is subsequently strung between posts.

The present invention is directed to a power operated post driver and has, as its principal goal, the provision of an implement which permits a single worker to drive posts without the need to use manual power for the driving force.

More specifically, it is an important object of the invention to provide a post driving implement which makes use of a portable power source to drive posts into the ground. The power source can be either a portable air compressor or a hydraulic system such as the type that is commonly available on tractors.

It is another important feature of the invention that the power source need not be accurately positioned and need not be moved each time a different post is to be set. By using hoses having substantial length, a number of posts can be driven in succession at different locations before it is necessary to move the compressor or tractor.

Still another object of the invention is to provide a post driving implement which is light enough to be easily carried and handled by a single worker.

A further object of the invention is to provide a post driving implement which is well balanced to facilitate its handling. The driving weight includes bars which are located on opposite sides of the post to assure proper balance and to uniformly distribute weight over the frame of the device.

A still further object of the invention is to provide a post driving implement which is constructed in a manner to readily receive a post and to be quickly and easily removed from the post at the end of the post driving operation. It is a particularly important feature of the invention that the implement can be removed to the side of the post so that it is unnecessary to lift it to an overhead position for removal.

An additional object of the invention is to provide a post driving implement which prevents posts from turning as they are being driven. The post is clamped to the frame of the implement in a manner preventing it from turning so that the studded face of the post can be easily maintained in the proper orientation to receive the fencing which is subsequently applied. The unique clamping mechanism has an over center linkage which is rigidly held in the clamped position to assure that the post will not inadvertently slip out of place.

Still another object of the invention is to provide a post driving implement having a power cylinder which is automatically reversed at the top and bottom of its strokes. This permits successive driving strokes to be automatically repeated until the post has been driven to the desired depth, at which time the operating lever can simply be released to deactivate the power cylinder.

A still further object of the invention is to provide a post driving implement which can be safely operated. The implement is equipped with a safety lever and locking pin which normally locks the unit to prevent accidental operation of the cylinder. The safety lever must be intentionally operated in order to release the locking pin and permit the cylinder to move the driving weight.

Yet another object of the invention is to provide a post driving implement of the character described which is able to drive a variety of different posts and which is simple and economical to construct, reliable in operation, and rugged enough to withstand repeated use and rough handling.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views:

FIG. 1 is a front elevational view of a post driving implement constructed according to a preferred embodiment of the present invention, with portions broken away for purposes of illustration and with the driving weight of the implement fully retracted;

FIG. 2 is a fragmentary front elevational view similar to FIG. 1 but showing the driving weight partially extended toward the raised position;

FIG. 3 is a fragmentary front elevational view similar to FIGS. 1 and 2, but showing the driving weight fully extended to the raised position;

FIG. 4 is a fragmentary front elevational view similar to FIGS. 1-3, but showing the clamp mechanism of the implement in its release position;

DETAILED DESCRIPTION OF THE INVENTION

Figure 5:
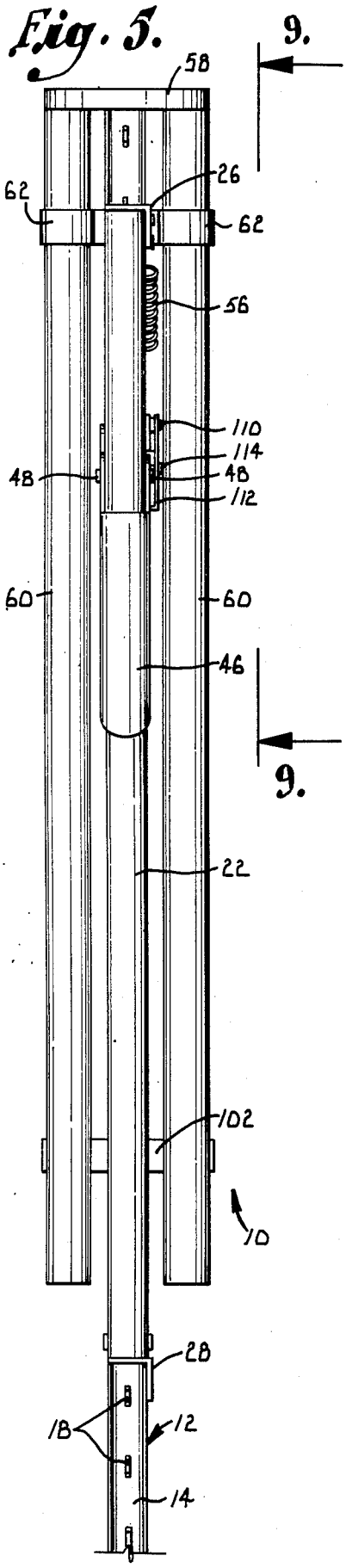
FIG. 5 is a side elevational view on an enlarged scale taken generally along line 5—5 of FIG. 1 in the direction of the arrows.
Figure 6:
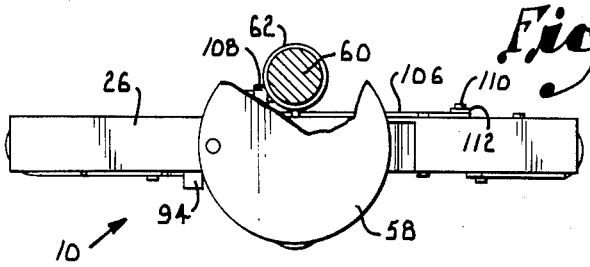
FIG. 6 is a top plan view of the implement taken generally along line 6—6 of FIG. 1 in the direction of the arrows, with a portion broken away for purposes of illustration.

Referring now to the drawings in more detail, numeral 10 generally designates a post driving implement constructed in accordance with a preferred embodiment of the present invention. The implement 10 is used to drive posts such as the metal fence post 12. The fence post 12 has a generally T shaped configuration and includes a generally planar front face 14 and a flange 16 which extends perpendicular to the front face from its center. Spaced apart along the length of face 14 are a plurality of projecting studs 18 which facilitate application of fencing to the post. The lower end portion of the post may have a barbed anchor plate 20 (see FIG. 1) which serves to securely anchor the post in the ground G.

The post driving implement 10 has a rigid rectangular frame which includes hollow metal tubes 22 and 24 on its opposite sides. The tubes 22 and 24 are parallel to one another and are sized to form handles which can be grasped in the hands during operation of the implement. Extending between the top ends of tubes 22 and 24 is an angle member 26. Another angle 28 extends between the lower ends of the tubes. The frame of the implement includes a third angle 30 which extends between tubes 22 and 24 at a location somewhat below the upper angle 26. The angle members are parallel to one another and may be welded or otherwise suitably secured to the tubes.

Figure 7:
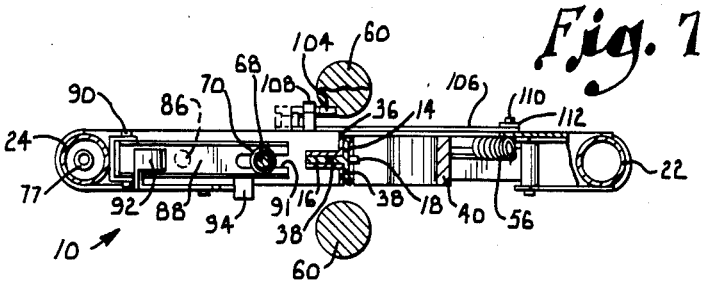
FIG. 7 is a sectional view taken generally along line 7—7 of FIG. 1 in the direction of the arrows.
Figure 8:
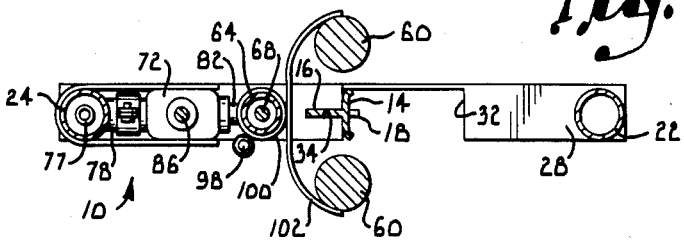
FIG. 8 is a sectional view taken generally along line 8—8 of FIG. 1 in the direction of the arrows.

In order to allow the frame of the implement to receive the fence post 12, the horizontal flange of the bottom angle member 28 is provided with a cut out 32 near its center, as best shown in FIG. 8. A thin slot 34 is formed adjacent to the cut out 32 to closely receive the flange 16 of the fence post. The top and intermediate angles 26 and 30 have similar cut outs formed in their horizontal flanges. Extending between the top and intermediate angles are a pair of vertical angles 36 which are best shown in FIG. 7. Each angle 36 has one of its flanges located in slots which are formed in the top and intermediate angle members 26 and 30. These flanges of angles 36 are spaced apart in order to present a slot 38 therebetween to receive the flange 16 of the fence post. The other flanges of the angles 36 form a backing plate against which the back side of the face 14 of the post is positioned.

The fence post 12 is clamped in place in the slots 34 and 38 and held against angles 36 by a clamp mechanism which includes a pivotal clamp 40. The top end of the clamp 40 is pivoted at 42 to the top angle 26 to permit the clamp member to pivot between the clamping position shown in FIG. 1 and the release position shown in FIG. 4. The clamp member 40 has a pointed toe 44 which, in the clamping position, is held against the studded face 14 of the post between an adjacent pair of studs 18. This securely clamps the post between the clamp 40 and the angles 36.

The clamp 40 is operated by an over center linkage which includes a hand lever 46 pivoted at 48 to tube 22 of the frame. A rigid link 50 has one end pivoted at 52 to the clamp 40 and its opposite end pivoted at 54 to an extension of the lever 46. A tension spring 56 is connected at its lower end with link 50 at a location offset from but close to the pivot pin 52. The top end of spring 56 is connected with angle 26.

When the hand lever 46 is pivoted to the clamping position shown in FIG. 1, the lever is held securely against tube 22 and holds the operating linkage in a rigid condition to securely maintain clamp 40 in the clamping position. In this condition of the linkage, pivot pin 54 is located above a straight line extending between pins 48 and 52, and this over center arrangement prevents the linkage from inadvertently releasing the clamp member 40. The force applied by spring 56 acts on link 50 in a manner tending to raise pin 54, and the spring thus assists in retaining the clamp mechanism in the clamping position. Consequently, once the overcenter position has been passed, the linkage locks clamp 40 against the post and lever 46 is held securely against tube 22.

The clamp can be released by pivoting the hand lever 46 upwardly to the release position shown in FIG. 4. Once pivot pin 54 has moved beneath a straight line extending between pins 48 and 52, the force of spring 56 acts to collapse the over center linkage and thereby maintains the clamp mechanism in its release position until the hand lever is again pivoted against tube 22. In the release position, clamp 40 has a substantially vertical orientation to provide sufficient room for a post to be inserted into the cut out areas and slots formed in the angle members of the frame.

Driving forces are applied to the fence post by a weight assembly which includes a solid metal disk 58 and two solid metal bars 60. The bars 60 take the form of elongated cylinders and are connected at their upper ends to diametrically opposed locations on the disk 58. The bars 60 are located on opposite sides of the frame and extend closely through a pair of guide rings 62 which are suitably secured to the top angle 26 of the frame. One ring 62 extends in front of the frame, while the other ring 62 extends to the rear of the frame an identical distance.

The weight assembly can be moved between the retracted or driving position shown in FIG. 1 and the fully raised position shown in FIG. 3. The close fit of the bars 60 in the guide rings 62 limits the bars to axial movement to restrict the weight assembly to linear up and down movement relative to the frame. The bars 60 have the same shape and weight so that the frame is balanced when the frame is held in the upright post driving position shown in FIG. 1. The weight balance keeps the implement from tending to tilt to one side during operation. Also, when the weight assembly is in the retracted position shown in FIG. 1 for storage, the weight is distributed relatively uniformly on the frame so that the implement can be easily handled.

Raising and lowering of the weight assembly is effected by a fluid operated power cylinder 64. The cylinder is parallel to tubes 22 and 24 and extends between the bottom angle 28 and the intermediate angle 30 at a location closer to tube 24 than to tube 22. The cylinder is thus offset to one side of the fence post 12. A movable piston 66 fits closely in the cylinder 64 and has a piston rod 68 which projects out of the top end of the cylinder. The top end of rod 68 is secured to the weighted disk 58. A compression spring 70 encircles the piston rod 68 at a location below the disk 58.

The power cylinder 64 is a fluid operated cylinder and, in the embodiment shown, is a pneumatic cylinder which utilizes compressed air to extend and retract the piston rod 68. However, it is to be understood that a hydraulic cylinder may be provided as an alternative and operated from the hydraulic system available on a tractor.

The flow of compressed air to cylinder 64 is controlled by a pair of three way air valves 72 and 74. The lower valve 72 is located adjacent to the lower angle 28, and the upper valve 74 is located immediately below the intermediate angle 30. Both valves receive air under pressure through a flexible, elongated air hose 76 which connects at one end with a portable air compressor (not shown). At the other end, hose 76 connects in a releaseable manner with a fitting 77 which connects with the bottom end of tube 24. Fittings 78 and 80 connect tube 24 with the respective valves 72 and 74 to supply air thereto. The outlet port of valve 72 connects with a fitting 82 which in turn connects with cylinder 64 near its bottom end. The outlet port of the upper valve 74 connects with a fitting 84 which leads to connection with cylinder 64 near its upper end.

The air valves 72 and 74 are operated in tandem by a common control rod 86. The top end of rod 86 is connected with a lever 88 which is pivoted at 90 to tube 24. Lever 88 has a notch 91 (see FIG. 7) in its free end through which the piston rod 68 extends. When the weight is lowered, spring 70 is compressed between disc 58 at the top and lever 88 at the bottom.

When lever 88 is in the horizontal position shown in FIG. 1, rod 86 places both of the valves 72 and 74 in the neutral position in which no air is applied to cylinder 64. When lever 88 is pivoted downwardly to the position of FIG. 2, rod 86 is moved downwardly to effect extension of the cylinder 64. In this condition, air is supplied to the cylinder through valve 72 at a location below the piston 66, and the air pressure above the piston is relieved by the upper valve 74. Consequently, the piston is forced upwardly and rod 68 is extended to lift the weight assembly of the post driving implement. When plate 88 is pivoted upwardly to the position of FIG. 3, cylinder 64 is in the retract mode. Then, air is supplied by valve 74 at a location above piston 66 and is relieved below the piston through valve 72. The piston rod then retracts to lower the weight assembly to the retracted position.

The valve control lever 88 is normally held in the neutral position by a pivotal hand lever 92 having a handle located adjacent to tube 24. The lever 92 is pivotal between the positions shown in FIGS. 1 and 2. In the position of FIG. 1, a tab 94 which projects from the valve operating lever 88 is engaged in a notch 96 formed in the hand lever 92. When the tab is engaged in the notch, lever 88 is held in the neutral position of FIG. 1. Accordingly, the hand lever 92 must be held in the released position of FIG. 2 in order to permit cylinder 64 to operate. A spring 97 continuously urges the hand lever 92 toward the engaged position of FIG. 1.

At both the top and bottom of its strokes, the piston rod 68 is reversed automatically. The automatic reversal mechanism includes a pin 98 which trips the valve operating lever 88 at the top of the piston stroke. Pin 98 is carried on and projects upwardly from a sleeve 100 which fits closely around the cylinder 64. Sleeve 100 is carried on a curved bracket 102 which is welded or otherwise secured at its opposite ends to the weighted bars 60. Pin 98 is located to contact and push upwardly against the free end of lever 88 when the piston rod has been fully extended to the position shown in FIG. 3. In addition to providing a mount for the pin 98, sleeve 100 in conjunction with the exterior of cylinder 64 assists in guiding the weight assembly as it is reciprocated up and down during operation of the post driver. Spring 70 acts to automatically reverse cylinder 64 at the bottom of its stroke, as will be described more fully.

Figure 9:
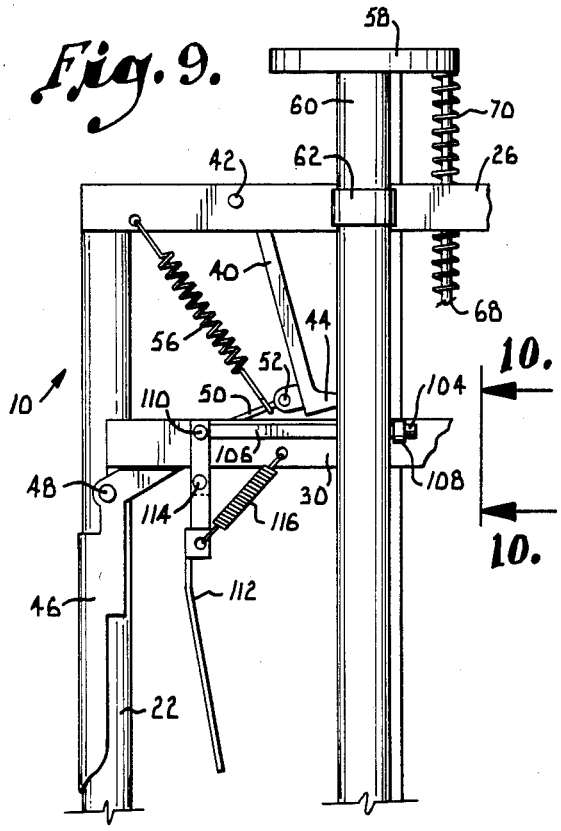
FIG. 9 is a fragmentary rear elevational view taken generally along line 9—9 of FIG. 5 in the direction of the arrows.
Figure 10:
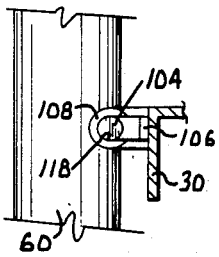
FIG. 10 is a fragmentary view on an enlarged scale taken generally along line 10—10 of FIG. 9 in the direction of the arrows.

The weight assembly is normally locked in the retracted position by a horizontal locking pin 104 which is best shown in FIGS. 7 and 9–10. The locking pin 104 is carried on the end of a flat arm 106 and is supported for axial sliding movement by a small sleeve 108 secured to the intermediate angle member 30 of the frame. The opposite end of the flat arm 106 is pivoted at 110 to the top end of a hand lever 112. The hand lever 112 is located near tube 22 of the frame and is pivoted at 114 to angle 30. A tension spring 116 is hooked at its top end to angle 30 and at its bottom end to lever 112 at a location below the pivot pin 114. The force of spring 116 thus continuously urges lever 112 toward the position shown in FIG. 9. In this position, the locking pin 104 is retracted into a small groove 118 (see FIG. 10) formed in one of the weighted bars 60. The fit of pin 104 in groove 118 locks the weight assembly in place and prevents the power cylinder from raising the weight.

The locking pin 104 can be released from groove 118 by pulling the hand lever 112 toward tube 22. This pivotal movement of the hand lever moves its top end to the right as viewed in FIG. 9 and thus extends the locking pin 104 to displace it from groove 118. Then, the weight assembly is released and can be lifted to the raised position. Whenever the hand lever 112 is released, spring 116 acts to return the locking pin 104 to its locking position. The locking pin prevents the implement from accidentally operating and requires that lever 112 be intentionally manipulated before operation can occur.

In use of the post driving implement 10, the clamp 40 is initially released, and hand lever 92 is in the position of FIG. 1 to lock the valve control lever 88 in the neutral position with the weight assembly fully retracted. A post such as the fence post 12 can then be inserted into the frame of the implement with the flange 16 of the post received in the slots 34 and 38. Lever 46 is then pivoted against tube 22 to move the clamp 40 against face 14 of the post between two of the studs 18. The top end of the post should project somewhat above the top angle 26. The fit of flange 16 in the slots 34 and 38, along with the rigid manner in which the fence post is clamped in place, prevents the post from turning or otherwise slipping relative to the frame of the implement. It should be noted that the post can move upwardly and downwardly to a limited extent relative to the frame until the toe 44 of clamp 40 engages the stud located above or below the toe of the clamp. The air hose 76 is normally connected with the implement before the post is in place, although this connection can be made after the post is in place if desired.

Once the fence post has been received by the frame of the implement and clamped in place, and the frame is held in the upright post driving position shown in FIG. 1. It should be noted that the elongate, flexible nature of the air hose 76 permits the post to be located as desired and does not require accurate positioning of the air compressor (or the tractor in the event of a hydraulicly operated cylinder). The tubes 22 and 24 provide convenient handles by which the frame of the implement can easily be held in the proper post driving position by a single worker. It is contemplated that the worker will stand on the rear side of the implement or on the side opposite that visible in FIG. 1.

With the post properly positioned, hand lever 112 can be pulled with the left hand toward tube 22 in order to release the locking pin 104 from groove 118. Lever 92 can then be pivoted toward tube 24 with the right hand in order to operate the post driver.

Spring 70 is at this time in a compressed state between disk 58 and the valve operating lever 88 and, the spring force causes lever 88 to pivot downwardly to the position of FIG. 2. In this position, valve 72 applies air under pressure below piston 66 and thereby causes the piston rod 68 to extend. The piston rod raises weight 58 a considerable distance above the top end of the post.

Once the weight has been raised far enough to release spring 70, the compression of spring 70 is relieved and the spring no longer applies a downward force on lever 88.

When the weight assembly reaches the raised position, the piston rod 68 is fully extended, and pin 98 engages tab 94 to push the valve operating lever 88 upwardly as shown in FIG. 3. Thus, at the top of the stroke, the power cylinder is automatically reversed, and air under pressure is applied to cylinder 64 above the piston 66. The pressurized air and the influence of gravity cause the weight assembly to drop forcefully on the top end of post 12, thereby applying a driving force to the post to advance the bottom end of the post into the ground. When the weight assembly reaches the driving position, spring 70 is again compressed between the disk 58 and the valve operating lever 88. Therefore, when the bottom of the piston stroke is reached, spring 70 forces lever 88 to the position of FIG. 2 and thereby automatically reverses the power cylinder such that it is again placed in the extension mode. The use of a compressible spring 70 for the reversal mechanism rather than a rigid member provides sufficient play to permit different posts to be accommodated.

In this manner, the combined weight of disk 58 and the two weighted bars 60 can be applied repeatedly to the top end of the post, with additional force applied by the pressurized air which serves to retract the piston rod. At the top and bottom of each cylinder stroke, the cylinder is automatically reversed so that repeated driving forces are applied to the fence post so long as levers 112 and 92 are held against tubes 22 and 24. When the post has been driven to the desired depth, lever 92 can be released so that the tab 94 is again engaged in notch 96 to lock the valve operating lever 88 in the neutral position, with spring 97 holding lever 92 in the engaged position. The safety lever 112 can be released so that spring 116 causes the locking pin 104 to lock the weight assembly in place in the retracted position.

The implement can then be removed from the post by releasing lever 46 to release clamp 40 and simply slipping the frame of the implement off to the side of the post. The cut out areas such as the cut out 32 shown in FIG. 8 readily accommodate removal of the implement sidewardly from the driven post. Another post can then be inserted into the implement and driven at a new location in the same manner. Due to the elongate, flexible nature of the air hose 76, the implement can ordinarily be moved to the next post location without requiring movement of the air compressor or tractor which serves as the power source for operating the implement.

It is thus apparent that a single worker can drive a number of posts without having to exert significant manual effort. The air compressor or hydraulic system applies all of the force necessary to drive the post, and the only manual labor involved is the holding of the implement. The implement is light enough in weight to be easily handled by a single worker, and the balanced arrangement of the weight assembly facilitates its handling. It is also important to recognize that the implement can be removed sidewardly from the post rather than requiring it to be raised to an overhead position as is necessary with other manual post driving devices. The implement 10 is small enough to be easily transported in the bed of a pickup truck, wagon or other vehicle.

Posts having shapes other than the T-shape shown for post 12 can be handled by making relatively minor changes in the implement, including round posts of the type used for chain link fences and wooden posts.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A post driving device comprising:

a portable hand held frame adapted to be hand held in a post driving position and having means for receiving a post and holding the post in a position to be driven into the ground when the frame is held in its post driving position;

releasable means for fixedly clamping the post to said frame, said releaseable clamping means having a release condition wherein the frame is unclamped from the post and can be removed sidewardly from the post after same has been driven into the ground a weighted driving member for application to the post to apply a driving force thereto;

means for mounting said driving member on said frame for generally up and down movement thereon between a raised position wherein the driving member is raised above the post and a driving position wherein the driving member is dropped onto top of the post; and power means for applying a lifting force to said driving member to raise same to the raised position and reversing said lifting force when the driving member reaches the raised position, whereby said driving member falls and is pushed to the driving position to forcefully drive the post into the ground.

2. The invention of claim 1, including:

control means for activating and deactivating said power means; and a hand lever on said frame for controlling the control means.

3. The invention of claim 1, including:

safety lock means for locking said driving member in the driving position thereof; and means for releasing said lock means to permit said driving member to be moved to the raised position.

4. The invention of claim 3, wherein said lock means includes:

a locking member mounted on said frame for movement between a locking position wherein said locking member acts to lock the driving member in the driving position and a release position wherein the driving member is released; and yieldable means for urging said locking member toward the locking position thereof.

5. The invention of claim 4, wherein said release means includes a hand lever on said frame for overcoming said yieldable means to effect movement of said locking member to the release position thereof.

6. The invention of claim 1, including:

a locking pin mounted on said frame for sliding movement between a locking position wherein said pin engages said driving member in a manner to lock same in the driving position thereof and a release position wherein said pin releases the driving member to permit same to be moved to the raised position;

yieldable means for urging said pin toward the locking position thereof; and a hand lever on said frame for effecting movement of said pin to the release position thereof.

7. The invention of claim 1, including:

a pair of handles on opposite sides of the frame adapted to be grasped in the hands for holding of the frame in the post driving position;

a first hand lever on said frame located adjacent one of said handles and operable to activate and deactivate said power means;

releaseable lock means for normally locking said driving member in the driving position thereof; and a second hand lever on said frame adjacent the other handle and operable to effect release of said lock means to permit the driving member to move to the raised position.

8. The invention of claim 1, wherein said releaseable clamping means includes:

a clamp member mounted on the frame for movement between a clamping position wherein the post is clamped to the frame and a release position wherein the post is removable from the frame; and an operating linkage for effecting movement of said clamp member between the clamping and release positions.

9. The invention of claim 8, including:

a spring acting on said linkage in a manner to retain the linkage in a rigid condition to rigidly hold said clamping member in the clamping position when moved thereto and acting on said linkage in a manner to retain the linkage in a collapsed condition to maintain the clamping member in the release position when moved thereto; and an operating lever on the frame for operating said linkage in a manner to overcome the force of the spring, thereby to effect movement of the clamping member between the clamping and release positions.

10. The invention of claim 1, wherein:

the post has a T shaped configuration and presents a studded face and a flange projecting therefrom; and said receiving means for the post includes a plurality of slots in said frame having a size to closely receive the flange of the post to prevent the post from turning relative to the frame during driving of the post.

11. The invention of claim 1, wherein said driving member includes:

a weight for application to the post; and a pair of weighted bars extending generally downwardly from said weight on opposite sides of the frame, said weighted bars being substantially identical in weight and shape to balance said driving member about the frame.

12. The invention of claim 11, including guide means on the frame for limiting said bars to generally axial movement relative to the frame.

13. The invention of claim 1, wherein:

said power means includes a fluid operated power cylinder on the frame having an extensible and retractable rod connected to said driving member to move same to the raised position when the rod is extended and to the driving position when the rod is retracted;

said cylinder is controlled by valve means having a first condition in which fluid under pressure forces the rod to extend and a second condition in which fluid under pressure forces the rod to retract; and said valve means has an actuating linkage which automatically effects the first condition of said valve means when said rod is fully retracted and which automatically effects the second condition of said valve means when said rod is fully extended.

14. A post driving implement comprising:

a frame having an elongated slot to receive a flange of a post having a generally T shaped configuration in section;

releaseable means for fixedly clamping the post to said frame with the post positioned to be driven into the ground, said releaseable clamping means being arranged to prevent the post from turning relative to the frame;

a weight for application to the top of the post to drive same into the ground;

means for mounting said weight on the frame for generally up and down movement between a raised position wherein the weight is raised above the post and a driving position wherein the weight is dropped onto the top of the post;

a fluid operated power cylinder on said frame having an extensible and retractable rod connected to said weight to effect movement of the weight to its raised position when said rod is extended and to its driving position when said rod is retracted;

valve means for controlling the application of fluid to said cylinder, said valve means having a first condition in which fluid under pressure is applied to said cylinder in a manner to extend said rod and a second condition in which fluid under pressure is applied to said cylinder in a manner to retract the rod;

means for effecting the first condition of said valve means automatically when said weight reaches the driving position; and means for effecting the second condition of said valve means automatically when said weight reaches the raised position.

15. The invention of claim 14, wherein:

said valve means has a neutral condition in which fluid pressure to the cylinder is relieved;

said valve means has a valve control lever having first and second positions effecting the respective first and second conditions of said valve means and a neutral position effecting the neutral condition of said valve means;

said means for effecting the first condition of said valve means includes spring means acting on said control lever in a manner to effect the first position thereof when said weight reaches the driving position; and said means for effecting the second condition of the valve means comprises a trip element carried on said weight at a location to trip said control lever in a manner to effect the second position thereof when said weight reaches the raised position thereof.

16. The invention of claim 15, including a hand lever mounted on said frame for movement between an engaged position wherein said control lever is maintained in the neutral position and a release position wherein the control lever is released for movement between the first and second positions thereof.

17. Post driving apparatus comprising:

a rigid portable hand held frame having means for receiving a post to be driven;

releaseable means for fixedly clamping the post to said frame at a location wherein the post is positioned to be driven into the ground when the frame is held by hand in a generally upright position, said releaseable clamping means being releaseable to permit the frame to be removed sidewardly from the post after same has been driven into the ground;

a weight assembly having a weighted driving disk for application to the top end of the post to apply a driving force thereto and a pair of elongate weighted bars extending from said driving disk, said bars being located on opposite sides of the frame and being substantially identical in shape and weight to substantially balance the weight assembly relative to the frame when the frame is held in its upright position;

means for mounting said weight assembly on the frame for generally up and down movement between a raised position wherein said driving disk is raised above the post and a driving position wherein said driving disk is dropped onto the top end of the post; and power means for applying a lifting force to said weight assembly to elevate same to the raised position and reversing said lifting force at the raised position of the weight assembly to permit said driving disk to fall to the driving position to forcefully drive the post into the ground.

18. The invention of claim 17, wherein said mounting means includes a pair of guide rings on the frame through which said weighted bars extend in a manner to restrict said weight assembly to substantially linear movement between the raised and driving positions.

19. The invention of claim 17, wherein said post receiving means is arranged to prevent the post from turning relative to the frame during driving of the post into the ground.

* * * * *